TEXTILE, YARN OR TAPE WINDING MACHINES

This invention relates to textile yarn (including filaments) or tape (either of artificial or natural material) winding machines and in particular to machines for winding yarn or tape which is delivered to the winder at a controlled or synchronous speed from a supply source such as an extruder.

It is very desirable with winders of this type to maintain a substantially constant tension on the yarn and tape being wound. The main cause of tension variation with a constant speed take-up spindle is the fact that as the diameter of the package being wound increases, the surface speed of the package (and hence the take-up speed of the yarn or tape), tends to increase but is restrained by the yarn or tape which is being delivered at a constant speed. This has the consequence of increasing the tension in the yarn or tape.

Various proposals have been put forward in an attempt to vary the drive to the take-up spindle to reduce the speed of rotation as the package diameter increases. Such proposals have hitherto tended either to be unduly complicated and expensive either to install or to maintain, or require too great an effort to operate to be useful when the tape or tape or yarn filament is light in weight.

The general object of this invention therefore is to provide a control for a variable speed driven take-up spindle which is suitable for a wide range of yarns or tapes particularly light weight yarn or tape being fed to the winder at a controlled speed.

A yarn or tape winder in accordance with this invention which satisfies this criteria comprises a take-up spindle which is arranged to be driven by a drive the torque/speed of which is variable in accordance with the setting of a torque variator device and a control device including means in the path of the tape or yarn prior to the take-up spindle to sense the tension in the tape or yarn and a control drive for the variator which is mechanically connected to the tension sensing means (preferably by a rotatable element) and which is effective to adjust the variator to alter the torque applied to the winding spindle when the yarn or tape tension varies beyond predetermined limits.

The advantage of having a drive for the variator as compared with an arrangement in which the variator is adjusted directly from the tension sensor, is that the sensor may be arranged so as to require very little force to move it and at the same time it can be arranged only to activate the drive for the variator when the tension varies beyond certain limits so as to avoid the condition in which any slight tremor in the yarn acts to adjust the spindle torque which would lead to a very unstable arrangement.

The control drive for the variator is preferably taken from the drive to the take-up spindle so that as the latter varies so does the former. This has the advantage that the speed of the take-up spindle varies rapidly during the initial build-up of a package on the spindle when the diameter of the package is small. The spindle speed on the other hand varies much more slowly once the package has reached significant size.

The spindle torque variator device may be of any convenient construction. One which is very effective comprises a magnetic drum and armature, one of which components is driven at a constant speed and the other of which transmits a drive to the spindle the strength of which depends on the position of the armature within the drum. The drive is at a maximum when the armature is located fully within the drum and a lesser drive is transmitted as the armature is moved progressively further out from the drum. When using such a variator device the control drive is arranged to cause a relative movement of the drum and armature.

The variator control drive is preferably adjustable so it can be disengaged either by an operator or automatically if the signal from the yarn or tape sensor continues despite a correction in the take-up spindle speed for example on the occasion of a yarn or tape breakage.

An embodiment of a yarn or tape winder in accordance with the invention will now be described by way of example and with reference to the accompanying drawings in which:-

FIG. 1 is a perspective view of the main drive components of the winder, and FIG. 2 is a detailed side elevation of the means by which the control drive is transmitted to the spindle torque variator.

Referring to FIG. 1 the winder comprises a take-up spindle 2 on which a package generally indicated at 4, is wound. The spindle 2 is driven by a constant speed drive device (not shown), through a toothed belt 6 and a spindle torque variator device generally indicated at 8 the output shaft 10 of which carries a pulley 12 engaging a further toothed belt 14 which drives a pulley 16 at one end of the spindle 2.

The spindle is mounted in bearings in a bracket device 18 which can pivot as the size of the package 4 which is being formed on the spindle, increases.

The tape generally indicated at 20 is fed to the package through a guide eye 22 which is traversed along the length of the package by a standard traverse mechanism (not shown) housed in a traverse box 24. The traverse box carries a roller 26 which is placed against the side of the package 4 so as to produce a tightly wound package.

In order to achieve a precision wound package the traverse mechanism, as is conventional, is driven in a constant relationship with the package. In the winder illustrated this is achieved by taking a drive from the other end of the spindle speed variator output shaft 10. A drive roller 28 is mounted on the shaft and drives a further roller 30 through a belt 32. The roller 30 is connected to a toothed pulley 34 which transmits the drive through a toothed belt 36 to a pulley 38 mounted on the drive input shaft of the traverse mechanism. It will be appreciated that the arrangement of the spindle, package and traverse box are not illustrated in the drawing in true perspective, for the sake of clarity.

The spindle speed variator 8 comprises a drum 40 of magnetic material and an armature 42 carrying a number of magnets 43 which is movable axially into and out from the drum 40 with the magnets in close proximity to the interior surface of the drum, the armature slides along the shaft 10 to which it is splined so as to be able to transmit a rotational drive. The drum 40 is driven by the belt 6 and when the armature 42 is located fully within the drum 40 the maximum drive is transmitted to the spindle. As the armature 42 is moved progressively from the drum 40 (to the right as seen in the drawing) the drive is progressively weakened and hence the spindle torque will drop.

The armature is moved relatively to the drum by means of a control device which acts in accordance with the tension of the tape 20 to transmit a drive to the armature to move it axially along the shaft 10.

EXPANDED

RETRACTED

EXPANDABLE COLLET

BACKGROUND OF THE INVENTION

Strand material is typically collected on a winder by winding the strands around a tube carried by a rotating collet. In the case of glass strads, glass filaments are attenuated through bushing tips or orifices at the bottom of a heated bushing containing molten glass. The filaments as they are attenuated are coated with a binder and/or size by passing the filaments across the surface of an applicator, which is constantly wetted with the binder and/or size to be applied. The filaments are then gathered into a unified strand by a gathering shoe, which is typically a grooved wheel or cylinder. The resulting strand may then be traversed in a vehicle riding in a cam or across the face of a roatating spiral and collected as a forming package on a forming tube carried by a rotating collet.

It is necessary to firmly hold the forming tube onto the face of the collet to avoid slippage of the tube as the collet is rotating. This is necessary, since the rotation of the tube with the forming package thereon provides the attenuative forces for the formation of the filaments. Filament diameter is directly proportional to the tension on the filaments from the rotating collet. Should the forming tube slip, uneven tension will be transmitted to the filaments and thus uneven strand diameter results. This produces an unacceptable product.

Several solutions to this problem have been employed by the prior art. A first solution is to form the face of the collet of a plurality of fingers which ride within slots or grooves and which are designed to expand outwardly from the collet due to centrifugal force when the collet is rotated. Thus, the face of a collet itself expands to firmly grasp the forming tube. An example of such a collet can be found in U.S. Pat. Nos. 2,891,798; 3,544,016 and 3,871,592. While this solution is satisfactory for collets having a large diameter, as, for example, 12 inches (30.5 centimeters) or more and rotated at high speeds, such a solution is unsatisfactory for collets of smaller diameter, i.e., in the order of 5 inches (12.7 centimeters) and rotated at slower speeds, as is often the case with larger diameter filaments, since the centrifugal forces necessary to expand the fingers is often insufficient. Further, when centrifugal force alone is employed to expand the collet surface and gravity is employed to retract the fingers forming the collet surface, it is clear that the fingers below the horizontal center line of the collet will not retract, due to the gravitational forces pulling downward on these fingers and thus maintaining these fingers in an expanded state.

A second possible solution which is commonly employed is to form the collet, or a portion thereof, of an expandable material and "blow-up" the collet by fluid pressure. This solution takes two forms. In one form, a bladder or hollow tube of expandable material forms at least a portion of the outer part of the collet and is expanded to firmly grasp the tube placed thereon. Typical of this form are U.S. Pat. Nos. 2,289,453; 2,621,867; 3,139,242; 3,394,902 and 3,834,257.

The other form which this solution may take is to form the collet having an interior tube or bladder which is expanded by air pressure to cause a plurality of protrusions located at the surface of the collet to be forced beyond and protrude from the surface of the collet by the bladded or tube when it is expanded. Typical of this solution are U.S. Pat. Nos. 2,215,069; 3,104,074 and 3,127,124.

A problem common to both forms of the fluid pressure solutions is that these collets tend to be unevenably balanced when expanded. This results in an eccentric rotation of the collet and the forming package and tube being carried thereon and thus the forming package will produce an uneven tension on the strand and an uneven diameter strand. This effect becomes even more pronounced as the collet speed is increased and thus the collet readily becomes unacceptable for the collection of glass strands. Further, if gravity alone is employed to retract the collet fingers, when they are employed in combination with a bladder, once again those fingers below the horizontal center line of the collet will not retract.

In U.S. Pat. No. 2,801,858, an expandable collet is disclosed which has a single expandable element which is expanded by compressing it at its ends to expand its diameter as its width is decreased. This is accomplished by manually forcing compaction elements towards each other to compress the expandable element therebetween. This type of collet is evenly balanced when expanded. This solution is useful, however, it requires an operator to manually force the compaction elements together, which has been found to be a time-consuming and thus inefficient operation. This method is also employed in U.S. Pat. No. 3,165,279, where the expandable element is extended by forcing a compaction element into it to expand its surfaces outwardly. This, too, requires a manual operation to accomplish the result.

In copending U.S. application Ser. No. 701,394, a winder is disclosed in which a plurality of expandable rings are interleaved interleaved with a plurality of unexpandable spacers, with fluid pressure being employed to expand and contract the diameter of the rings and firmly grasp a forming tube. This winder has an uneven surface along its length due to the fact that the forming tube only contacts the outer surface of the expanded rings when they are in their expanded state. Because of this, the forming tubes which must be employed are heavy cardboard tubes which, in order to remove the forming package from the tube after winding, must be destroyed, such as by unwinding the spirally wound cardboard employed to form the tube, crushing the tube, and the like.

It is desirable, therefore, to produce a collet having a relatively even surface so that thin-walled forming tubes, such as paper forming tubes, which can easily be removed from the forming package by folding the tube and which may thus be reused several times before discarding, may be employed.

It is also desirable, therefore, to produce an expandable collet having the advantages of being evenly balanced to produce a uniform rotation, having the quickness of expansion found in the "blown-up" collets to conserve time in doffing and replacing the forming tube and thus reduce costs and increase efficiency, and to produce a collet which has a relatively smooth surface of the expandable finger type to allow thin-walled forming tubes to be placed thereon for collection of the strand while providing for complete retraction of the fingers when the collet is not being rotated to allow the forming tubes to be placed thereon and removed therefrom easily.

THE PRESENT INVENTION

The present invention combines the ease of operation of airoperated expandble collets with the precise rotation found in the manually expanded collets, while providing a relatively smooth surface and allowing the use of thin-walled forming tubes by employing expanding fingers. The collet of the present invention comprises a sealed chamber into which a fluid may enter under pressure, a piston which reacts to the fluid pressure, a plurality of expandable rings, a plurality of spacers between the rings and at the end of the rings opposite the piston, a plurality of expandable fingers surrounding the rings and spacers and means for connecting the fingers to the rings. The piston, rings, spacers and fingers are all carried along a common shaft around which they are rotated and are so arranged that, upon introducing a fluid under pressure into the sealed chamber, the piston and spacers transfer this pressure to the expandable rings. This pressure on the rings causes the rings and the fingers to expand and the fingers to firmly grasp a tube, such as a thinwalled paper forming tube. Upon release of the fluid pressure, the pressure is relieved from the expandable rings, causing the rings to return to their original size and shape, with the means connecting the rings and the fingers exerting a force on the fingers to return them to their unexpanded state and release the tube.

BRIEF DESCRIPTION OF THE DRAWINGS

The expandable collet of the present invention can best be described with reference to the accompanying drawings in which.

DETAILED DESCRIPTION OF THE DRAWINGS

Figure 1:
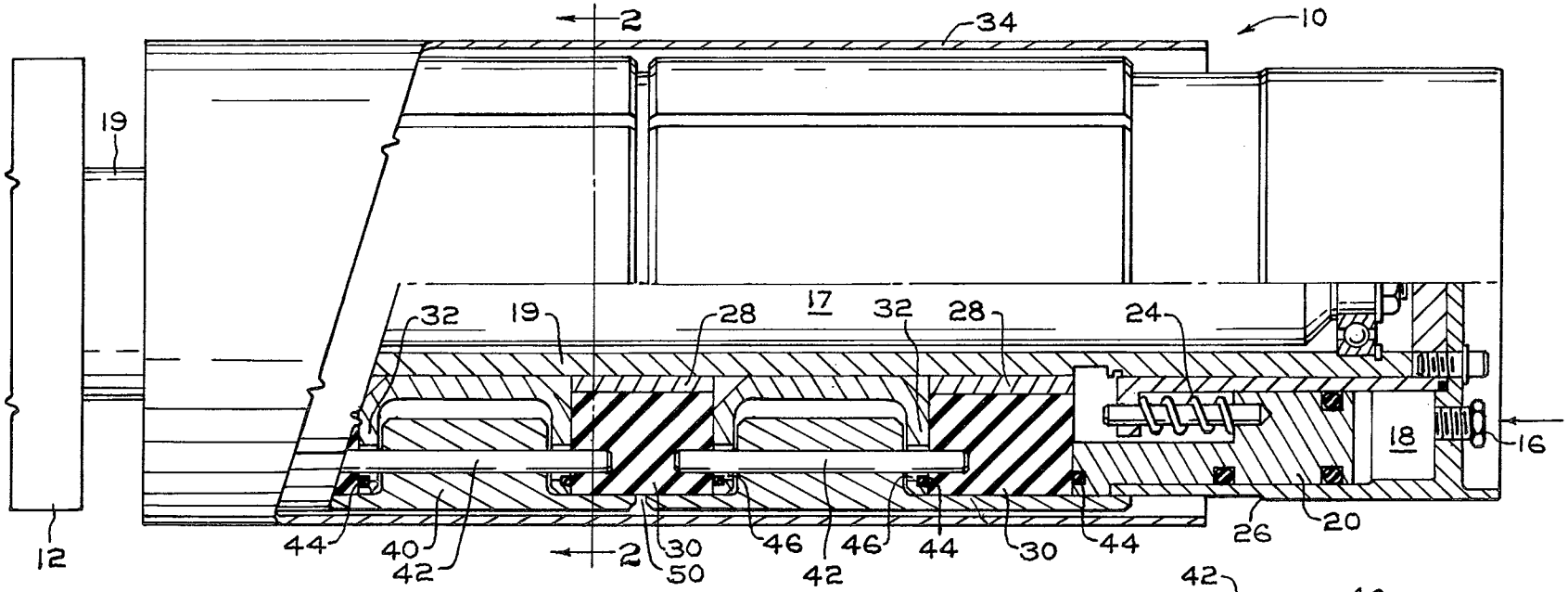
FIG. 1 is a side elevational view, partly in section, of the collet of the present invention.

Turning now to the figures, the expandable collet of the present invention is generally illustrated as 10. The collet 10 is connected to a winder 12 through shaft 19 around which the collet 10 rotates. The shaft 19 is connected to a motor, not shown, within the winder 12, the motor supplying the rotational forces for the collet 10, and surrounds a stationary supporting shaft 17. The collet 10 includes a fluid inlet 16, such as a sealed valve, which is detachably connected at one end to a source of fluid under pressure, not shown, and at its other end to a fluid chamber 18. The fluid chamber 18 is internally sealed. As th fluid under pressure enters the sealed chamber 18, and the internal pressure within the chamber 18 increases, piston 20, due to the fluid pressure within the chamber 18, presses against expandable ring 30. Piston 20 is connected to a spring 24 which returns piston 20 to its original position upon release of fluid pressure. Stop 26 limits the unexpanded position of the piston 20.

Figure 2:
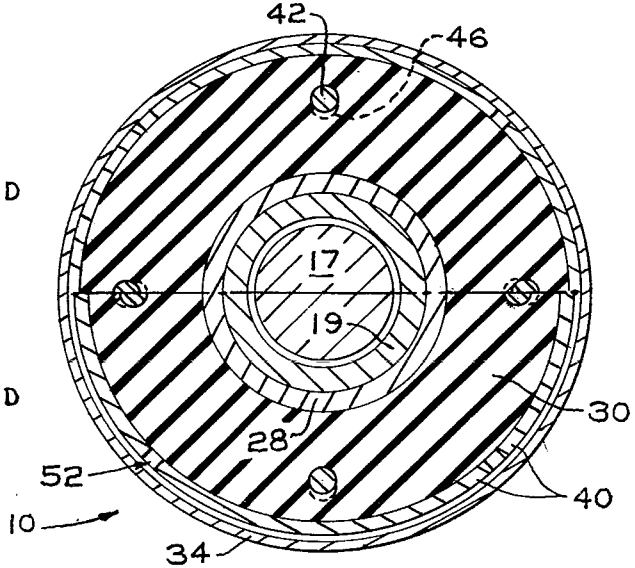
FIG. 2 is a cross-sectional view taken through line 2—2 of FIG. 1, illustrating the expandable collet of the present invention both in its expanded and unexpanded states.

Adjacent to piston 20 are a plurality of expandable rings 30 which are separated by spacers 32 between them and at the end of the collet 10 opposite piston 20. As the fluid pressure builds, forcing the piston 20 toward the expandable rings 30, these rings, which are typically solid rubber rings or doughnuts having a central opening with metal rings 28 fitted therein, increase in diameter and decrease in width. This also decreases the distance between the outside ends of the outermost rings 30. The spacers 32, which are typically formed of a material such as brass, stainless steel or aluminum, are unable to expand, and thus distribute the force equally on the rings 30. As can be seen in FIG. 1, the spacers 32 are designed in shape to exert pressure only on the rubber rings 30 and not on the metal insert rings 28. Thus, as shown, the spacers 32 may be cut out in the area of the metal rings 28. As the rings 30 expand, they exert an outward force on the metal fingers 40 and expand these fingers to tightly grasp a forming tube 34 which is surrounding them. As can best be seen in FIG. 2, the outward expansion of each of the fingers 40 is limited to the height of the opening or slot 46 in the spacers 32 through which connecting members 42 pass minus the diameter of the connecting members 42. The purpose of these connecting members will be more fully described below. The tube 34 may be a relatively thick-wall tube formed of a material such as cardboard, but is preferably a thin-walled tube formed of a material such as paper, which tube may be reused several times to form a plurality of packages before being discarded. The spacers 32 and the expandable rings 30 are carried by the shaft 19 and rotate with it. The piston 20, the spacers 32, and the rings 30 are slideably mounted on shaft 19, except for the spacer (not shown) at the end opposite the piston 20, which is preferably fixed in position.

As previously mentioned, as the rings 30 expand in diameter, they decrease in width. Thus, gap 50 is provided between adjacent fingers 40 to allow for this contraction. When the collet 10 is expanded, this gap 50 decreases and, in fact, the fingers 40 could meet, aiding in providing a smooth surface to the expanded collet 10. However, a small gap 50 between adjacent fingers 40 during winding will not adversely affect the operation of the collet 10. Likewise, the longitudinal slots or gaps 52 between adjacent fingers 40 do not adversely affect the operation of the collet 10.

When a complete forming package has been formed and it is desired to remove the forming package from the collet 10, fluid pressure is released from the fluid inlet 16, thus equivalently decreasing the pressure on the piston 20, the spacers 32, and the expandable rings 30. The spring 24 forces piston 20 into its unexpanded position, further relieving pressure on the expandable rings 30 and allowing them to return to their unexpanded state, i.e., with an increased width and decreased diameter.

When the rings 30 are retracted, the fingers 40 are also retracted. This is accomplished by means of connecting rods 42. These rods pass through the fingers 40 and spacers 32 and are embedded within or otherwise attached to the rings 30. As the rings 30 return to their unexpanded state, the rings 30 exert a pulling force on the connecting rods 42, which force is then transferred to the fingers 40 to return them to their unexpanded state. This loosens the grasp on the forming tube 34 and allows the operator to remove tube 34 with the accompanying forming package of strand thereon.

Further pressure to retract the fingers 40 may be placed on the connecting rods 42 by means of O-rings 44. These rings, which are typically formed of elastomeric materials, such as rubber, also expand as the rings 30 expand and the connecting rods 42 push against these rings. When, however, the rings 30 are retracted, the elastic force of the O-rings 44 against the connecting rods 42 aid in retracting these rods and the fingers 40.

The complete pressurization of the collet to grasp the forming tube 34 may take place in a time period of about 0.5 to 1.5 seconds, with a fluid pressure ranging from about 30 to about 55 psig (204,082 to 374,150 pascals). The depressurization may take place in about 1 to 3 seconds. The fluids which may be employed to pressurize the system include liquid fluids, such as water, but preferably are gaseous fluids, such as nitrogen, oxygen, helium, carbon dioxide, and especially air.

From the foregoing, it is obvious that the collet of the present invention provides an effective means for collecting strand materials, such as glass strands, which is free from the problems encountered in the collets of the prior art.

While the invention has been described with reference to certain specific embodiments thereof, it is not intended to be so limited thereby, except insofar as in the accompanying claims.

We claim:

1. In a collet for collecting strand material on a tube comprising:

a fluid inlet, a sealed fluid chamber, a piston, a plurality of expandable rings, a plurality of unexpandable spacers between said rings and at the end of said rings opposite said piston, a shaft slideably carrying said piston, rings, and spacers and means for rotating said collet, said piston, rings, and spacers being arranged such that upon passing a fluid into said chamber and pressurizing said chamber said pressure is transferred by said piston and said spacers to said rings to expand said rings and upon release of said fluid pressure said piston and said spacers release the pressure from said expandable rings to return said rings to their unexpanded state, the improvement comprising a plurality of fingers surrounding said rings and spacers and means connecting said fingers to said rings, said fingers being capable of firmly holding said tube in place during winding of said strand material and said means connecting said fingers to said rings being capable of acting with said rings to retract said fingers when the fluid pressure is released to thereby release said tube.

2. The collet of claim 1 wherein said expandble rings are solid rubber rings having a central opening and having a metal ring fitted in said opening.

3. The collet of claim 1 wherein said piston is spring-loaded.

4. The collet of claim 1 wherein said fluid is air.

5. The collet of claim 4 wherein said air is at a pressure of between 30 and 55 psig (204,082 and 374,150 pascals).

6. The collet of claim 1 wherein said tube is a thin-walled paper tube.

* * * * *